US010458759B2

(12) United States Patent
Fu

(10) Patent No.: US 10,458,759 B2
(45) Date of Patent: Oct. 29, 2019

(54) SHOOTING TARGET APPARATUS

(71) Applicant: Xiaomin Fu, Brentwood, TN (US)

(72) Inventor: Xiaomin Fu, Brentwood, TN (US)

( * ) Notice: Subject to any disclaimer, the term of this patent is extended or adjusted under 35 U.S.C. 154(b) by 0 days.

(21) Appl. No.: 15/476,933

(22) Filed: Mar. 31, 2017

(65) Prior Publication Data

US 2018/0283830 A1 Oct. 4, 2018

(51) Int. Cl.
*F41J 1/10* (2006.01)
*F41J 7/06* (2006.01)

(52) U.S. Cl.
CPC .. *F41J 7/06* (2013.01); *F41J 1/10* (2013.01)

(58) Field of Classification Search
CPC ..... F41J 7/06; F41J 1/10
USPC ..... 273/390
See application file for complete search history.

(56) References Cited

U.S. PATENT DOCUMENTS 7,694,973 B1 * 4/2010 Hofmeister ..... F41J 7/06 273/391
9,448,044 B1 * 9/2016 Swailes ..... F41J 7/06
2006/0192091 A1 * 8/2006 Martin ..... F41J 3/0023 250/221
2006/0290063 A1 * 12/2006 Hagar ..... F41J 7/04 273/369
2015/0260487 A1 * 9/2015 Steil ..... F41J 7/04 273/390
2017/0199013 A1 * 7/2017 Sensenig ..... F41J 7/04

* cited by examiner

*Primary Examiner* — John E Simms, Jr.
*Assistant Examiner* — Rayshun K Peng
(74) *Attorney, Agent, or Firm* — Lewis Roca Rothgerber Christie LLP

(57) ABSTRACT

A wirelessly controlled electrically driven shooting target system(s) that can transition from concealed position to ready position and then back to concealed position. It can be used in a variety of shooting environments. The shooting target apparatus includes the following main components: Mainhouseing with base, interchangeable target holder, TTP130 gearbox, camshaft, double torsion spring (DTS), leaf spring, main housing meshing gear, four magnets, wireless receiver and the remote goes with it. According to one embodiment, activation of drive mechanism to active the camshaft compress DTS, then magnets attracting and disconnection to cause movement of the target holder, the key mechanism is reserve potential energy and fast conversion of kinetic energy from potential energy, which achieved by magnets attracting and disconnection. Also included is a wireless signal receiver for receiving a wireless control signal to activate the drive mechanism to cause movement of the target holder from the concealed position to the revealed position and from revealed position to the concealed position.

2 Claims, 9 Drawing Sheets

Attachment 1

Attachment 3

Attachment 4

Attachment 5

Attachment 6

Wireless rotational target

Attachment 7

Attachment 8

Attachment 9

SHOOTING TARGET APPARATUS

BACKGROUND

Field

The present invention relates to shooting target apparatus for handgun and rifle shooting.

Description of the Related Art

Handgun and rifle shooting are popular sports but shooting ranges are limited and/or lack variations in terms of location and/or arrangement.

Various types of shooting targets have been developed and sold, including both stationary and moving targets. The invention seeks vary widely and are largely driven by the particular needs of the shooter and the specific environment in which the targets are used.

SUMMARY OF THE INVENTION

This invention provides the shooter with a more dynamic target environment, and move the target with a drive mechanism that is powered by battery pack, which drives the magnets engaging and disengaging from point to point. The key mechanism is converting from lower power produce high torque, with the help of compiling pressure with double torsion spring (DTS), reserve potential energy, magnets engaging and disengaging, emerge fast conversion of kinetic energy from potential energy.

According to the invention, there is provided an electrically-driven shooting target apparatus that can transition between facing user (ready position) and concealed position, and can be used in a dynamic target environment. The shooting target apparatus include a removable target holder, power source, motor driven mechanism, springs, magnets, gearbox (TTP130), camshaft, the electrically driven mechanism attached to the movable target holder and a target assembly.

The target holder is attached on the magnet, which carry out magnets engaging and disengaging the drive mechanism to cause movement of the target to go from the concealed position to the ready position and then back to the concealed position. The invention also included a wireless signal receiver and a wireless controller to activate the drive mechanism remotely.

BRIEF DESCRIPTION OF DRAWINGS

The invention will now be described in conjunction with the accompanying drawings in which:

First Embodiment of the Invention

FIGS. 2D to 2F each show a perspective side view of a shooting target apparatus, with a target holder thereof between the concealed position that is horizontal, a transitional position, and a revealed position that is vertical, respectively, according to the first embodiment of the present disclosure.

Second Embodiment of the Invention

Figures 1A, 1B, 1C:
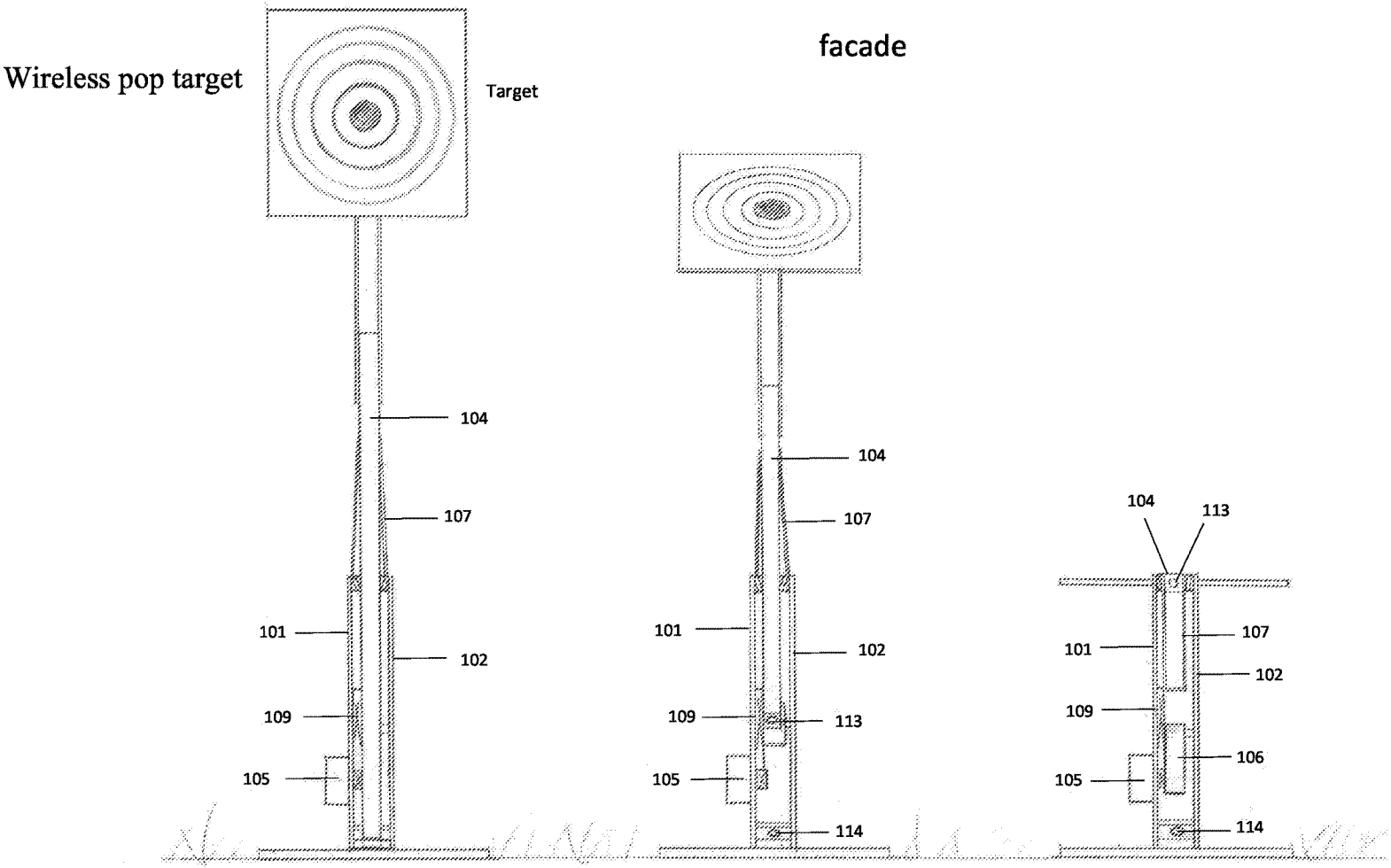
FIGS. 1A to 1C each show a front view of a first embodiment of shooting target apparatus (wireless pop target) in accordance with the invention, with a target holder thereof between the concealed position that is horizontal, a transitional position, and the revealed position that is vertical, respectively.
Figures 2A, 2B, 2C:
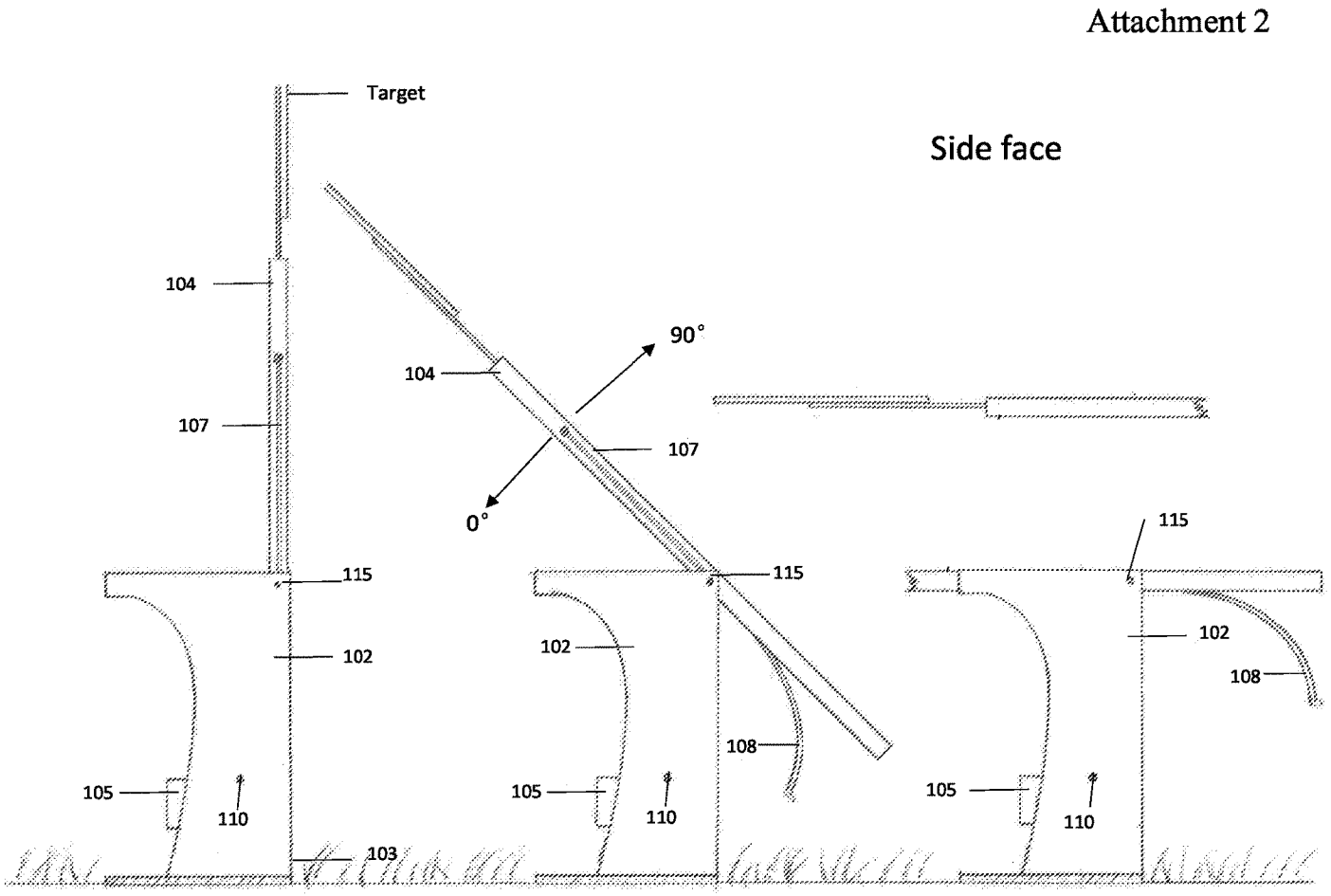
FIGS. 2A to 2C each show a perspective side view of a shooting target apparatus, with a target holder thereof between the concealed position that is horizontal, a transitional position, and the revealed position that is vertical, respectively, according to the first embodiment of the present disclosure.
Figures 3A, 3B:
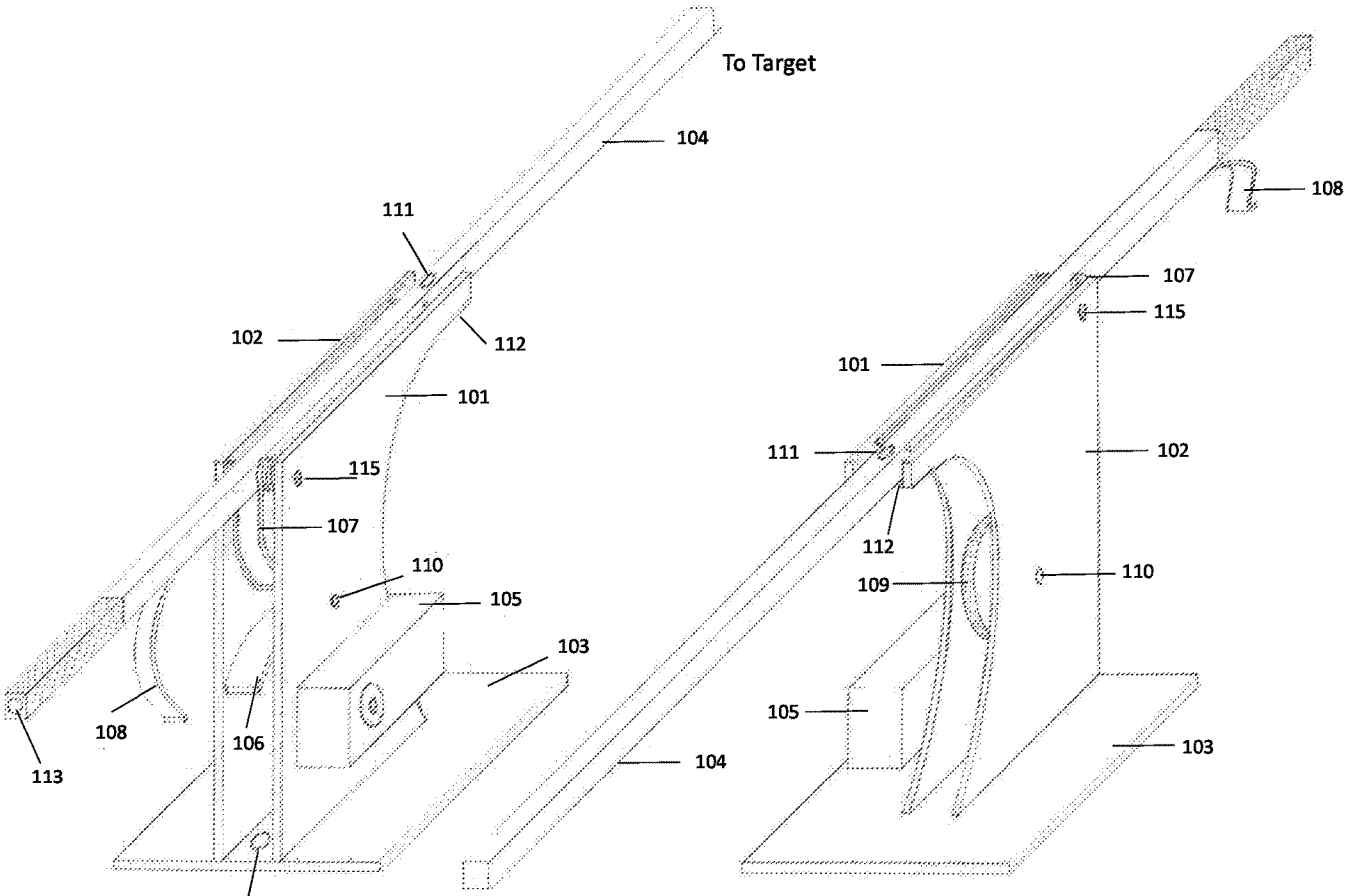
FIGS. 3A to 3B each show a perspective structure view of the shooting target apparatus, showing its internal components, according to the first embodiment of the present disclosure.
Figures 4A, 4B, 4C:
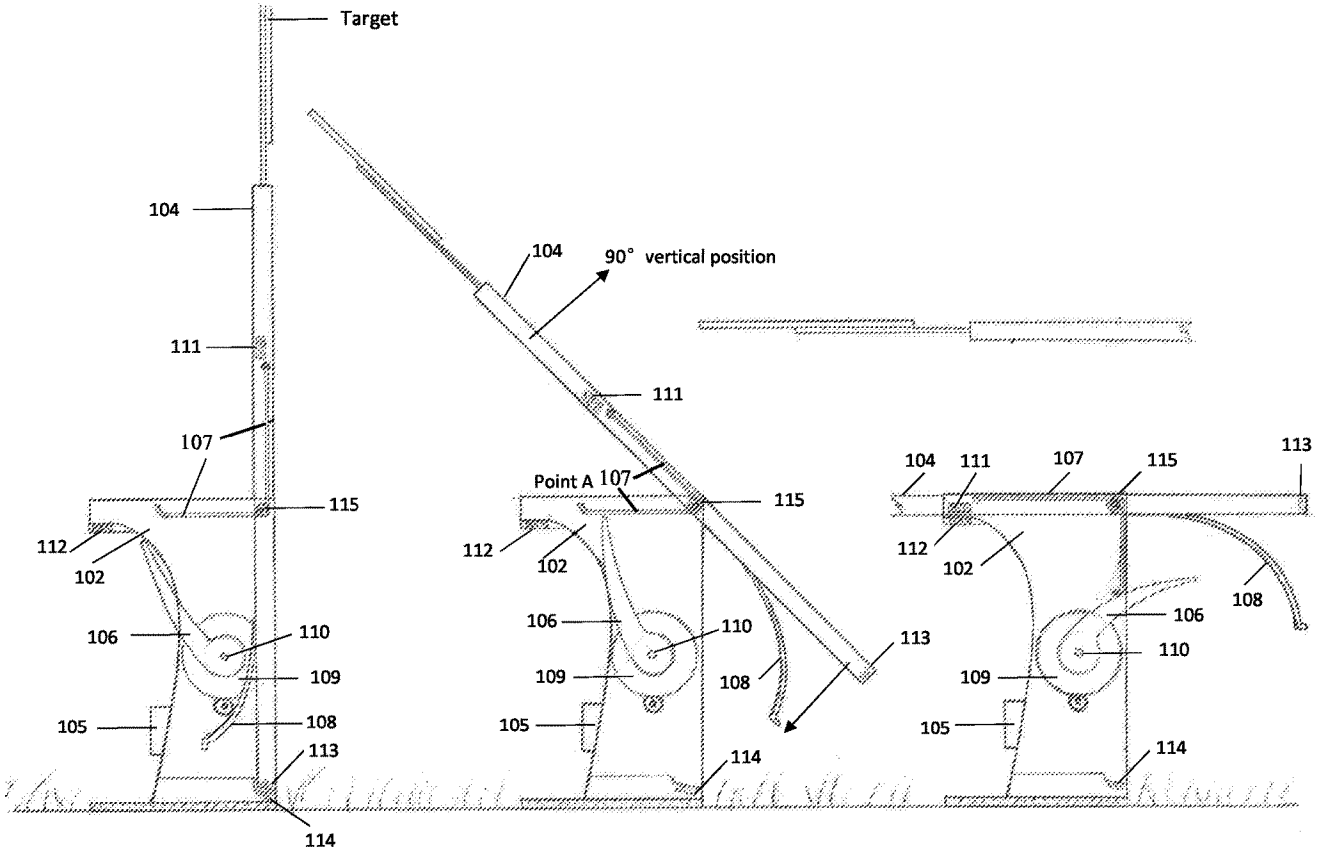
FIGS. 4A to 4C each show a perspective view of a driven mechanism of the shooting target apparatus for moving the target holder, according to the first embodiment of the present disclosure.
Figures 5A, 5B, 5C:
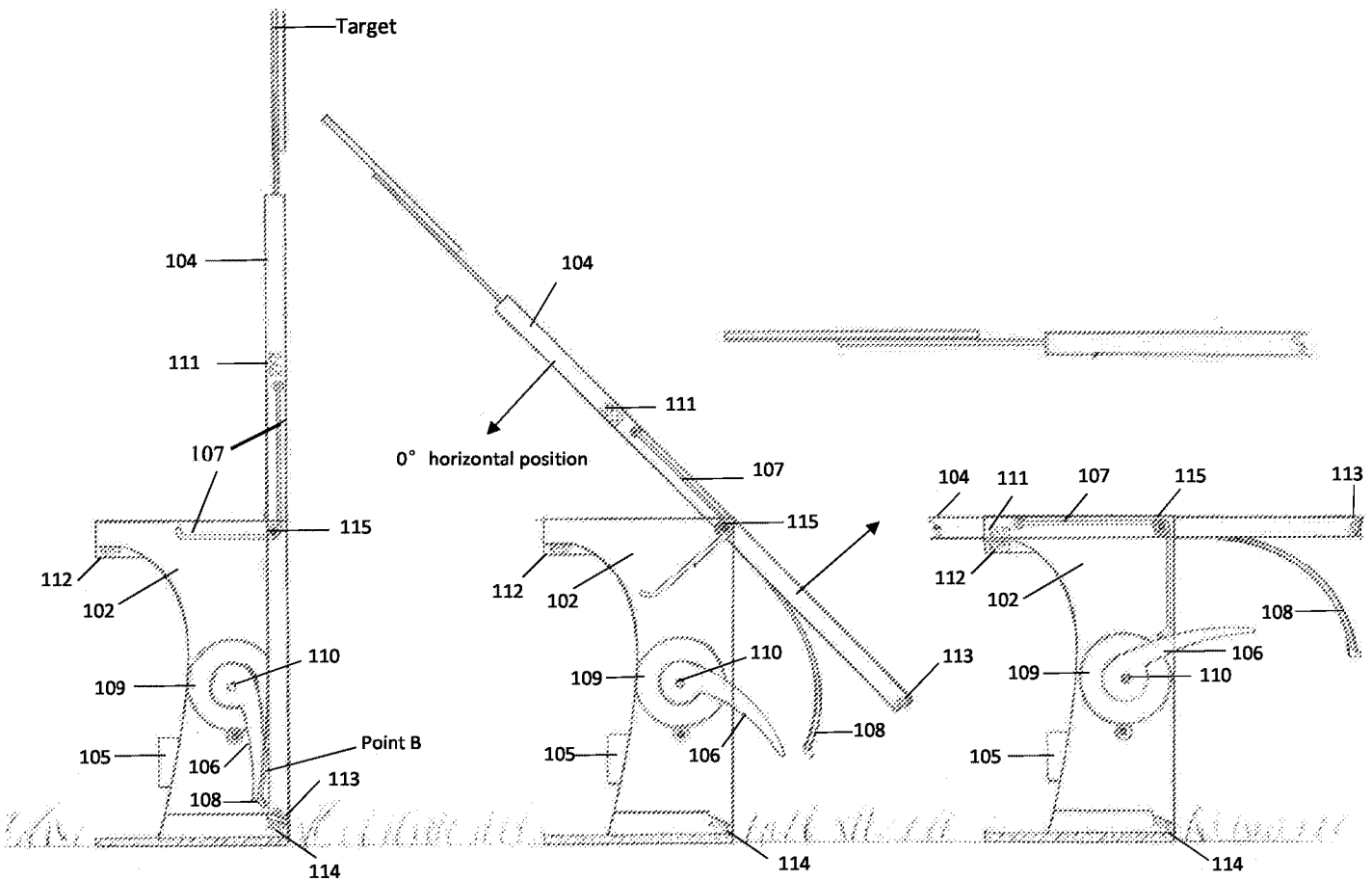
FIGS. 5A to 5C each show a perspective view of a driven mechanism of a shooting target apparatus for moving the target holder, according to the first embodiment of the present disclosure.
Figures 6A, 6B, 6C:
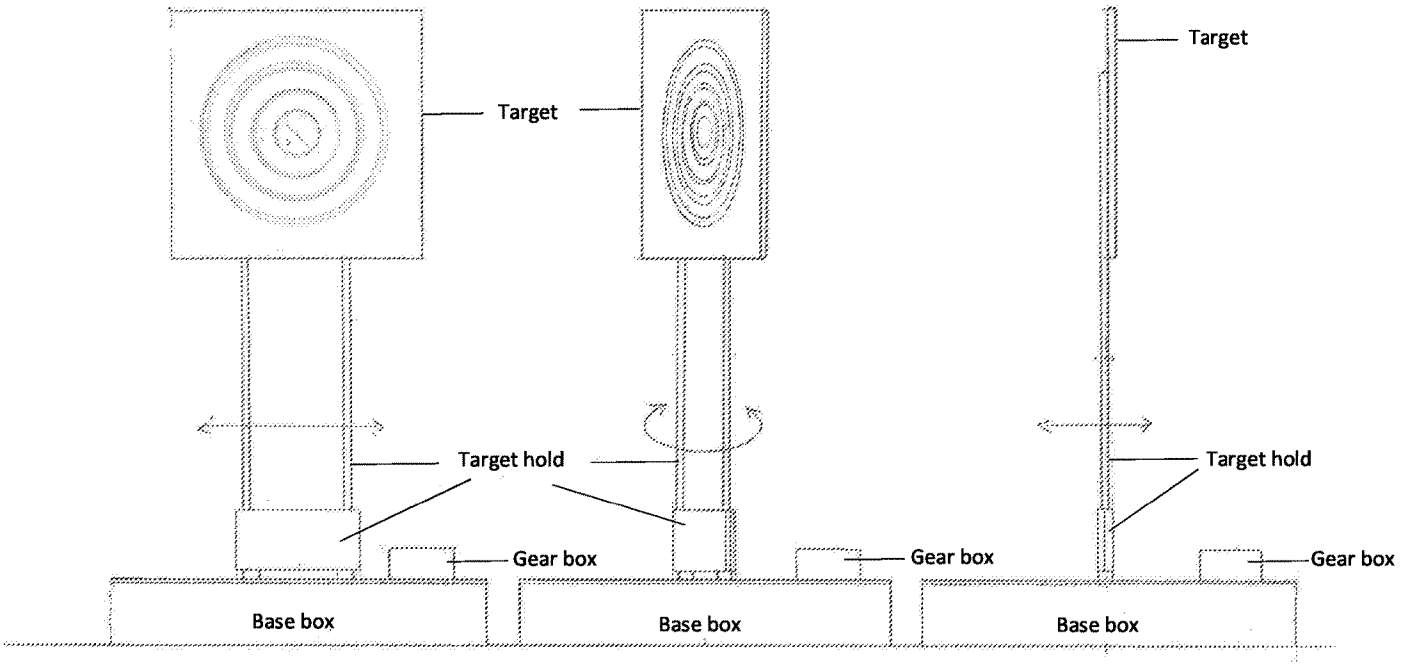

FIGS. 6A to 6C each show a front view of a second embodiment of shooting target apparatus (wireless rotational target), with the target holder thereof between the concealed position, a transitional position, and the revealed position.

Figure 7:
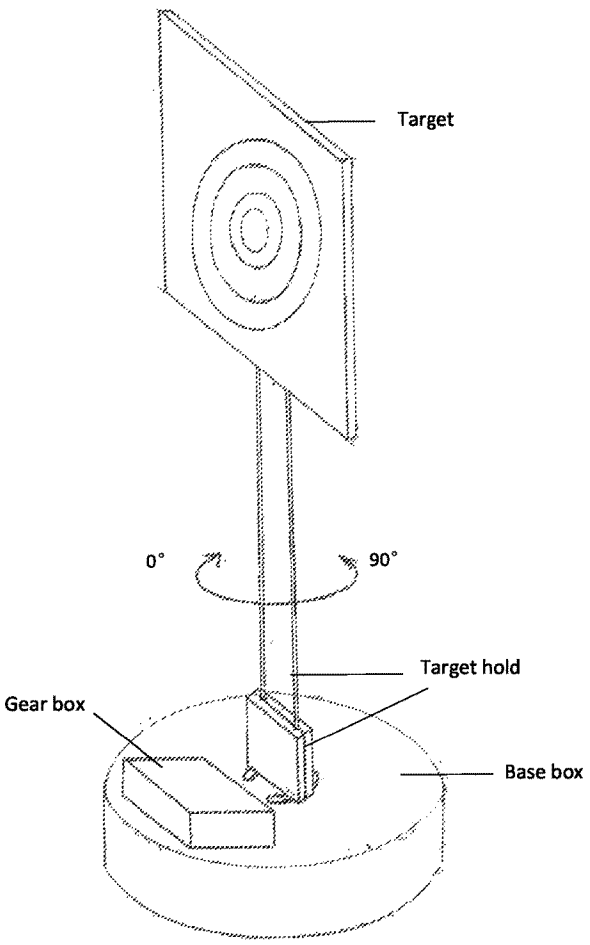

FIG. 7 is a perspective view of the shooting target apparatus, rotation target between 0° and 90° according to the second embodiment of the present disclosure.

Figure 8B:
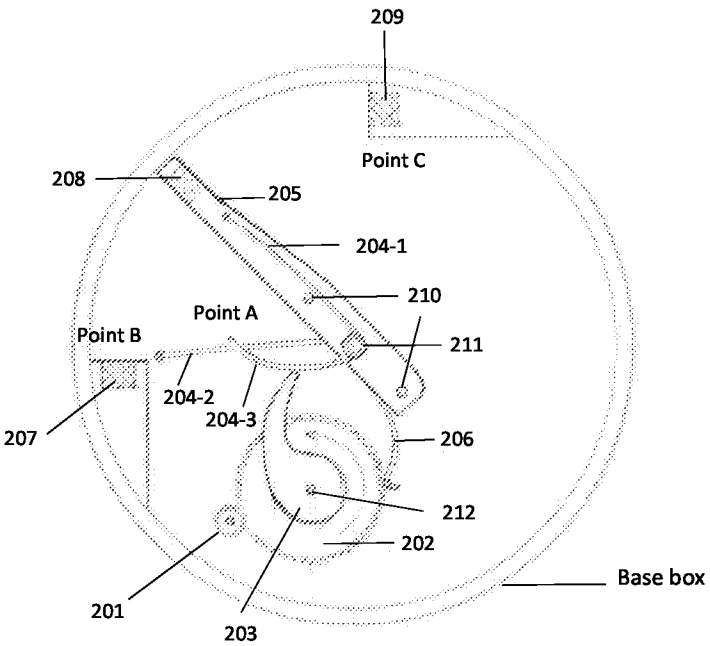
Figure 8A:
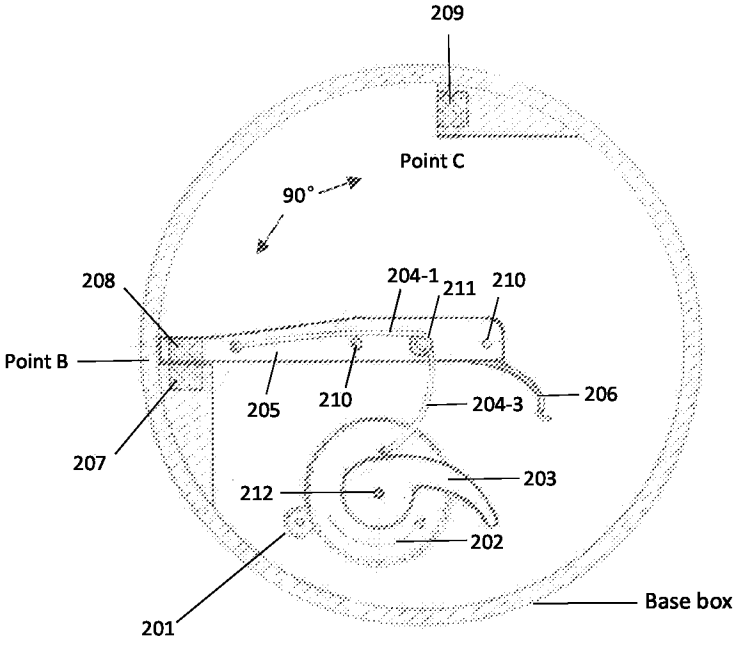

FIGS. 8A to 8B each show a perspective structure view of the shooting target apparatus B, showing its internal components, and viewing the driven mechanism of shooting target apparatus (rotational target apparatus B) in accordance with the invention, with a target holder thereof between the concealed position that is 90° and the revealed position that is 0°, according to the second embodiment of the present disclosure.

Figure 9B:
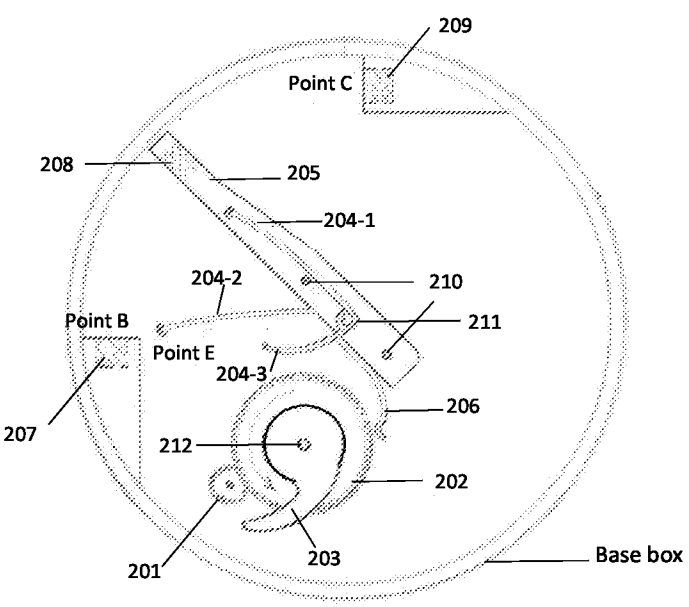
Figure 9A:
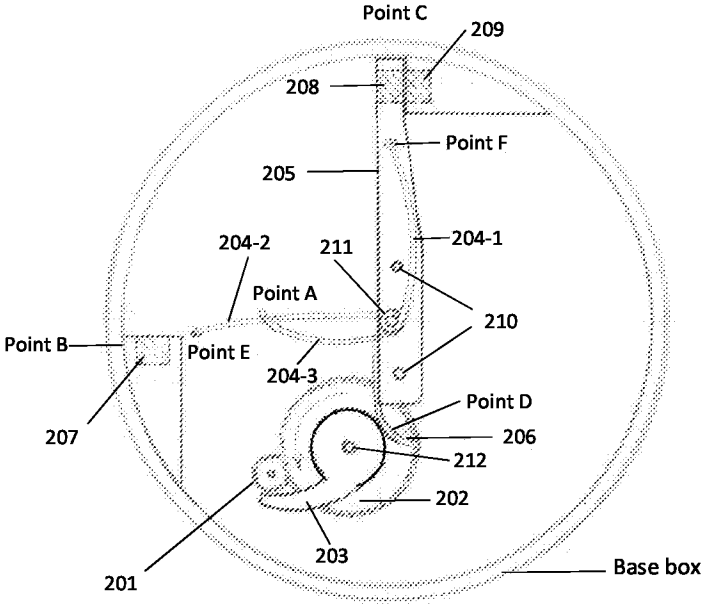

FIGS. 9A to 9B each show a perspective structure view of the shooting target apparatus B, showing its internal components and the driven mechanism, for driving a target holder thereof between a revealed position that is at 0° and a concealed position that is at 90, respectively, according to the second embodiment of the present disclosure.

DESCRIPTION OF PREFERRED EMBODIMENTS

Aspect 1 (Attachment 1 to 5)—Wireless Pop Target*

*The entire target system is held together by three main housing components: left main housing assembly (101), right main housing assembly (102) and the base (103)

Upon receiving signal from the remote, gearbox (105) will be activated by the power source to drive the main housing meshing gear (109) causing camshaft (106) to rotate and compress the double torsion spring (107), once the double torsion spring (107) reaches Point A (see attachment 4) magnet (111) and magnet (112) would disengage causing the double torsion spring (107) to release target holder (104) while the target holder pin (115) holding it in place forcing target holder (104) to change position to help magnet (113) to engage with magnet (114) located on the base (103). At this point the target system has completed its first half of the cycle moving from concealed (vertical) position to ready (horizontal) position. While the target is still in ready position, the second half of the cycle already began with the camshaft (106) started rotating towards Point B and compressing the leaf spring (108) causing the magnet (113) to disengage with magnet (114) which reuniting magnet (111) and magnet (112) therefore the target will appearing to be concealed again.

Aspect 2 (Attachment 6 to 9)—Wireless Rotational Target

Once the activate signal is received from the remote gearbox will be activated, causing meshing gear (201) to rotate meshing gear (202) and the camshaft (203) which compiling pressure on double torsion spring (204-3), once the double torsion spring (204-3) is compressed to reach Point A (see attachment 8) magnet (207) and magnet (208) will disengage and combine force released from double torsion spring (204-1) to push the lever (205) (held in place by axis (211)) to rotate towards Point C (see attachment 8) after the lever completes the 90° turn at Point C, magnet (208) and magnet (209) will engage and hold the lever (205) in place which holds the target in place, at this point the system has completed the first half of the cycle. As soon as the lever (205) finishes the cycle, the second half of the cycle begin with camshaft (203) starting to turn towards Point D and activating the torque rod (206) to disengage magnet (208) and magnet (209) with the double torsion spring (204-2)'s help (this DTS is held down on to the base by Point E) to disengage magnet (208) and (209) and push the lever (205) back to Point B from Point C and reengaging magnet (207) and magnet (208**), which is how to make the target going from facing the user (ready position) to concealed position.

Double torsion spring (204-1) is held on to the lever (205) by Point F located on the lever (205**) Please see attachment 8

Also included is a wireless signal receiver for receiving a wireless control signal to activate the drive mechanism.

Aspect 1 (Attachment 1 to 5)

1. This target system is held together by three main hosing components: left main housing assembly (101), right main housing assembly (102) and the base (103)
2. Upon receiving signal from the remote
3. Gearbox (105) will be activated by the power source to drive the main housing meshing gear (109) causing camshaft (106) to rotate and compress the double torsion spring (107)
4. Once the double torsion spring (107) reaches Point A (see attachment 4) magnet (111) and magnet (112) would disengage causing the double torsion spring (107) to release target holder (104)
5. While the target holder pin (115) holding it in place forcing target holder (104) to change position to help magnet (113) to engage with magnet (114) located on the base (103)
6. To complete the rest of the cycle, the target has to move from ready (horizontal) position back to concealed (vertical) position.
7. While the target is still in ready position, the second half of the cycle already began with the camshaft (106) started rotating towards Point B and compressing the leaf spring (108) causing the magnet (113) to disengage with magnet (114)
8. Reuniting magnet (111) and magnet (112) therefore the target will appearing to be concealed again.

Aspect 2 (Attachment 6 to 9)

1. Once the activate signal is received from the remote
2. Gearbox will be activated, causing meshing gear (201) to rotate meshing gear (202) and the camshaft (203) which compiling pressure on double torsion spring (204-3)
3. Once the double torsion spring (204-3) is compressed to reach Point A (see attachment 8) magnet (207) and magnet (208) will disengage and combine force released from double torsion spring (204-1) to push the lever (205) (held in place by axis (211**)) to rotate towards Point C (see attachment 8)

Double torsion spring (204-1) is held on to the lever (205) by Point F located on the lever (205**) Please see attachment 8
4. After the lever completes the 90° turn at Point C, magnet (208) and magnet (209) will engage and hold the lever (205) in place which holds the target in place
5. To complete the rest of the cycle the target has to move from the ready position (facing user) to vertical concealed position
6. As soon as the lever (205) finishes the cycle, the second half of the cycle begin with camshaft (203) starting to turn towards Point D and activating the torque rod (206) to disengage magnet (208) and magnet (209)
7. With the double torsion spring (204-2)'s help (this DTS is held down on to the base by Point E) to disengage magnet (208) and magnet (209) and push the lever (205) back to Point B from Point C and reengaging magnet (207) and magnet (208), which is how to make the target going from facing the user (ready position) to concealed position.

The invention claimed is:

1. A shooting target system comprising:

a main housing comprising two walls facing each other, and a base connected to the two walls, a meshing gear inside the main housing, a camshaft connected to the meshing gear, a target holder pivotally attached to the main housing through a target holder pin, a target attached to a first end of the target holder, a leaf spring connected to a second end of the target holder opposing the first end of the target holder, a double torsion spring connected to the target holder and between the target and the leaf spring, a first magnet on a first location of the main housing, a second magnet on the base of the main housing, the first location being spaced apart from the base, a third magnet on a first location of the target holder and a fourth magnet on a second location of the target holder, the first and second locations of the target holder being spaced apart, a remote control, a power source, and a gearbox on one of the two walls of the main housing, wherein the shooting target system is to move the target between a concealed position and a ready position, wherein in the concealed position, the first magnet and the third magnet are engaged to hold the target holder in a horizontal position; and in the ready position, the first magnet and the third magnet are disengaged to hold the target holder in a vertical position, wherein to change from the concealed position to the ready position:

the remote control is to send a signal, the gearbox is to be activated by the power source upon receiving the signal, the activated gearbox is to drive the meshing gear to rotate the camshaft, and the camshaft is to compress the double torsion spring to reach a first point, where a potential energy in the double torsion spring is to be converted to kinetic energy to disengage the first magnet and the third magnet and to release the target holder from the horizontal position, and the target holder pin is to hold the target holder on the main housing when changing position to help the fourth magnet to engage with the second magnet located on the base, to thereby put the target in the ready position, wherein to change from the ready position to the concealed position, while the target is still in the ready position, the camshaft is to rotate towards a second point and compress the leaf spring, where a potential energy in the leaf spring is to be converted to kinetic energy to cause the fourth magnet to disengage with the second magnet and to reunite the first magnet and the third magnet, thereby putting the target in the concealed position again.

2. A shooting target system comprising:

a base box, a first meshing gear and a second meshing gear inside the base box, the first meshing gear connected to the second meshing gear, a camshaft connected to the second meshing gear, a lever pivotally attached to the base box, a target attached to the lever, a torque rod attached to a first end of the lever, a double torsion spring connected to the lever at a first location between the first end and a second end of the lever, and connected to the base box at a second location, a first magnet on a first location of the base box, a second magnet on a second location of the base box, a third magnet on the second end of the lever, a remote control, a power source, and a gearbox on the base box, wherein the shooting target system is to move the target between a concealed position and a ready position, wherein in the concealed position, the first magnet and the third magnet are engaged to hold the lever at a 0° position; and in the ready position, the second magnet and the third magnet are engaged to hold the lever at a 90° position, the lever at the 0° position and the lever at the 90° position form a 90° angle, wherein to change from the concealed position to the ready position:

the remote control is to send an activate signal, the gearbox is to be activated, causing the first meshing gear to rotate the second meshing gear and the camshaft, and the camshaft is to compile pressure on the double torsion spring to reach a first point, where a potential energy in the double torsion spring is to be converted to kinetic energy and to disengage the first magnet and the third magnet and combine force released from the double torsion spring to push the lever to rotate towards the second location of the base box from the first location of the base box, after the lever completes a 90° turn from the first location of the base box to the second location of the base box, the third magnet and the second magnet are to engage and hold the lever in place to keep the target in the ready position, wherein to change from the ready position to the concealed position, the camshaft is to turn towards a second point and activate the torque rod to disengage the third magnet and the second magnet, and the double torsion spring is to help to disengage the third magnet and the second magnet and push the lever back to the first location of the base box from the second location of the base box and reengage the first magnet and the third magnet, thereby making the target go from the ready position to the concealed position.

* * * * *